US005321338A

United States Patent [19]

Nuckolls et al.

[11] Patent Number: 5,321,338

[45] Date of Patent: * Jun. 14, 1994

[54] LAMP STARTING CIRCUIT

[75] Inventors: Joe A. Nuckolls; Isaac L. Flory, IV, both of Blacksburg, Va.

[73] Assignee: Hubbell Incorporated, Orange, Conn.

[ * ] Notice: The portion of the term of this patent subsequent to Dec. 24, 2008 has been disclaimed.

[21] Appl. No.: 699,808

[22] Filed: Jun. 14, 1991

Related U.S. Application Data

[63] Continuation of Ser. No. 374,068, Jun. 30, 1989, Pat. No. 5,047,694.

[51] Int. Cl.[5] ..... H05B 41/14

[52] U.S. Cl. ..... 315/290; 315/205; 315/276; 315/289; 315/DIG. 5

[58] Field of Search ..... 315/290, 289, 276, 205, 315/DIG. 5

[56] References Cited

U.S. PATENT DOCUMENTS

| | | | |
|---|---|---|---|
| 3,679,936 | 7/1972 | Moerkens | 315/205 |
| 3,699,385 | 10/1972 | Paget | 315/239 |
| 3,710,184 | 1/1973 | Williams | 315/227 |
| 3,771,014 | 11/1973 | Paget | 315/136 |
| 3,889,152 | 6/1975 | Bodine, Jr. et al. | 315/205 |
| 3,917,976 | 11/1975 | Nuckolls | 315/258 |
| 4,072,878 | 2/1978 | Engel et al. | 315/205 |
| 4,092,565 | 5/1978 | Neal | 315/283 |
| 4,143,304 | 3/1979 | Hitchcock et al. | 315/276 |
| 4,209,730 | 6/1980 | Pasik | 315/290 |
| 4,337,417 | 6/1982 | Johnson | 315/290 |
| 4,415,837 | 11/1983 | Sodini | 315/177 |
| 4,461,982 | 7/1984 | Fähnrich | 315/290 |
| 4,695,771 | 9/1987 | Hallay | 315/290 |
| 4,958,107 | 9/1990 | Mattas et al. | 315/289 |
| 5,047,694 | 9/1991 | Nuckolls et al. | 315/290 |

FOREIGN PATENT DOCUMENTS

| | | | |
|---|---|---|---|
| 0044080 | 4/1977 | Japan | 315/289 |
| 52-46684 | 4/1977 | Japan . | |
| 54-10584 | 1/1979 | Japan . | |
| 54-68080 | 5/1979 | Japan . | |

*Primary Examiner*—Eugene R. LaRoche
*Assistant Examiner*—Son Dinh
*Attorney, Agent, or Firm*—Jerry M. Presson; Walter C. Farley

[57] ABSTRACT

A hot restart circuit includes a storage capacitor and SCR connected across a tapped portion of a ballast with a breakdown device to start the SCR. A charging circuit for the storage capacitor includes a diode, pumping capacitor and choke in series from the ballast tap to the AC line and a further diode interconnecting the capacitors. The pumping capacitor increases the charge on the storage capacitor in a step-wise fashion until the breakdown voltage is reached, whereupon starting pulses are applied to the lamp.

11 Claims, 3 Drawing Sheets

LAMP STARTING CIRCUIT

This is a continuation application of Ser. No. 374,068 filed Jun. 30, 1989 U.S. Pat. No. 5,047,694.

This invention relates to an improved circuit for starting, operating and hot restarting a high pressure sodium (HPS) lamp using a simple, non-resistive circuit which incorporates a voltage multiplying technique.

BACKGROUND OF THE INVENTION

As is well known in this art, HPS lamps, generally speaking, are difficult to start and require special circuitry for restarting if the lamp is extinguished after sufficient operation to elevate its temperature. This is normally referred to as hot restarting and is known to require high voltage across the lamp, considerably higher than the line operating voltage.

Numerous circuits have been developed for the purpose of hot restarting such lamps, as well as starting and operating circuits, and many of those circuits operate quite satisfactorily. However, the operative circuits which are commonly used include numerous resistors and/or pulse transformers, apart from the conventional ballast, to accomplish the starting operation. The resistors, which are commonly low resistance but have high wattage ratings, generates significant heat, necessitating special designs to either extract the heat or package the circuit in such a way that the heat does not damage other components. In addition to the heat generation, the resistive losses are wasteful of energy and the use of the resistors as well as pulse transformers increase the cost of the circuits.

SUMMARY OF THE INVENTION

Accordingly, an object of the present invention is to provide an HPS lamp starting, operating and hot restarting circuit in which the hot restarting circuit is non-resistive in the sense of not requiring any separate resistive components which would introduce losses and generate heat.

A further object is to provide a circuit which is simple and has a minimum of components and includes no separate pulse transformer.

Briefly described, the invention includes a starting, operating and hot restarting circuit for a high pressure sodium lamp comprising the combination of terminals connectable to an AC source, connector means connectable to a high pressure sodium lamp and an inductive ballast connected between the terminals so as to be in series with the lamp across the AC source. The ballast includes first and second winding portions with a tap at the junction of those portions, the second portion having a significantly larger number of windings than the first. A semiconductor switch is connected to the first portion of the ballast at the junction of the ballast with the lamp connector and a storage capacitor is connected between the tap and the other end of the semiconductor switch. A voltage sensitive breakdown device is connected across the switch so as to respond to the capacitor voltage and to breakdown when its voltage threshold is reached, placing the switch into conduction. The switch and capacitor are connected to the first portion so that, when the switch conducts, a pulse of current passes through the first portion, inducing a large voltage in the second portion which is applied to the lamp to start the lamp. A charging circuit is connected between the tap and the other side of the line, the charging circuit including a first diode in series with a pumping capacitor and a choke and a second diode, oppositely poled from the first, connected between the pumping capacitor and the junction of the storage capacitor with the switch. The diode polarities are such that the pumping capacitor is charged during one half of each AC cycle and the storage capacitor is charged during the other half of each cycle to a voltage higher than the half cycle amplitude of the source by an amount proportional to the charge on the pumping capacitor, the voltage on the storage capacitor thus increasing during each cycle until the breakdown device conducts.

BRIEF DESCRIPTION OF THE DRAWINGS

In order to impart full understanding of the manner in which these and other objects are attained in accordance with the invention, particularly advantageous embodiments thereof will be described with reference to the accompanying drawings, which form a part of this specification and wherein.

DESCRIPTION OF THE PREFERRED EMBODIMENTS

Figure 1:
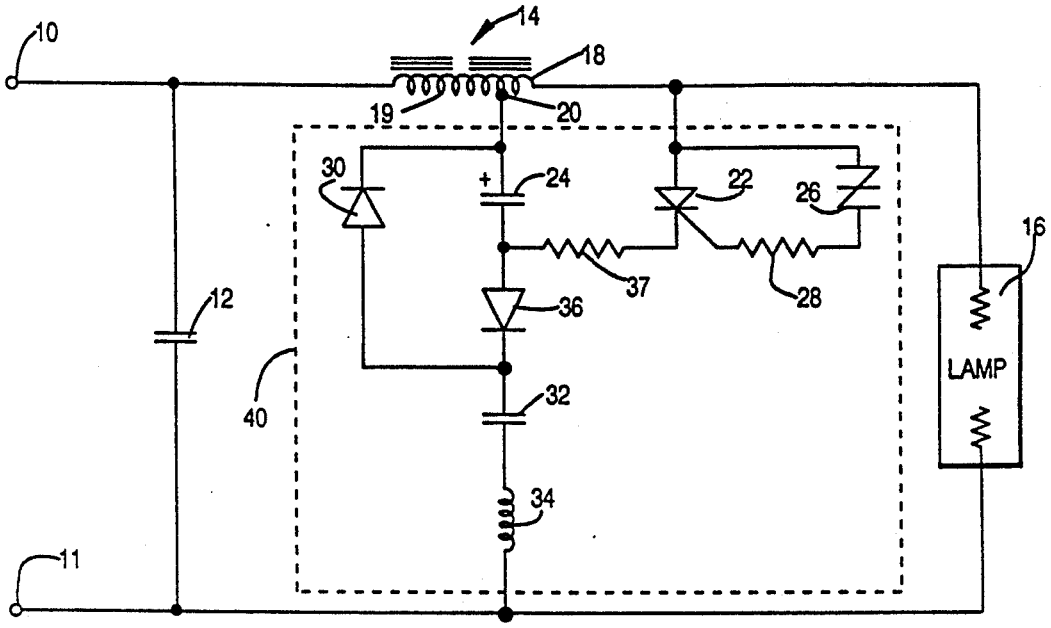
FIG. 1 is a schematic circuit diagram of a hot restart circuit in accordance with the present invention.

In the circuit shown in FIG. 1, terminals 10 and 11 are provided so as to be connectable to a suitable AC source which would typically be 240 V. line voltage. A power factor correcting capacitor 12 is connected between terminals 10 and 11 in a conventional manner. An inductive ballast indicated generally at 14 has one end terminal connected to terminal 10 and the other end terminal connected to one terminal of a high pressure sodium lamp 16, the other side of lamp 16 being connected to terminal 11. Thus, the ballast and lamp are in series circuit relationship with each other across the AC source terminals.

Ballast 14 is a tapped ballast such that it has a first winding portion 18 and a second winding portion 19 which are inductively coupled, portion 18 constituting a much smaller number of windings than portion 19, preferably on the order of about 5% of the total number of windings of the ballast. A tap 20 is provided at the junction between winding portions 18 and 19.

A semiconductor switch 22 such as a silicon-controlled rectifier (SCR) or the like is connected so that one end of its switchable conductive path is connected to the end of first portion 18 of the ballast and a storage capacitor 24 has one end connected to tap 20. The other end of the capacitor is connected to the other end of the conductive path of SCR 22. A sidac 26 or other breakdown device is connected between the gate and anode of the SCR, a current-limiting resistor 28 being included in series with the sidac if the characteristics thereof require current limitation.

As will be recognized from the circuit thus far described, the SCR, capacitor 24 and sidac are connected such that if the voltage on capacitor 24 is increased to a level such that it reaches or exceeds the threshold voltage of the breakdown device, the sidac will become conductive, placing the SCR in a conductive state and discharging the capacitor through winding portion 18. Because the windings are inductively coupled, portion 18 acts as the primary of a transformer, inducing voltage in the significantly larger winding portion 19, generating a high voltage therein which is then imposed upon lamp 16. As is well understood from a circuit of this type, proper selection of winding relationship creates a voltage which is sufficiently high to start a lamp.

A charging circuit for capacitor 24 is connected between tap 20 and terminal 11 at the other side of the AC source. This charging circuit includes a first diode 30, a pumping capacitor 32 and a radio frequency choke 34, these components being connected in series between tap 20 and terminal 11. A second diode 36 is connected between capacitor 24 and capacitor 32 and is poled in the opposite direction from diode 30.

The circuit including SCR 22, the sidac, capacitors 24 and 32, diodes 30 and 36 and RF choke 34 will be referred to as the starter circuit 40. The operation of circuit 40 is as follows.

During one half cycle of the AC supply, a current flows through choke 34, capacitor 32 and diode 30 to charge capacitor 32. This capacitor is chosen to be relatively small, significantly smaller than capacitor 24, typically having a value of about 0.047 mfd. On the next half cycle, capacitor 24 is charged and the voltage across capacitor 32 aids the incoming source half wave so as to deliver energy on the order of 2.7 millijoules to storage capacitor 24. Capacitor 24, which can be on the order of 5 microfarads, obviously requires more energy than can be supplied by the incoming source and capacitor 32 in one cycle. Accordingly, on the next half cycle, capacitor 32 is again charged and again delivers energy to capacitor 24 on the subsequent half cycle, each subsequent cycle increasing the charge on capacitor 24 in a kind of voltage multiplying or pumping action. With capacitors of the value indicated, approximately 25 cycles are required to charge capacitor 24 to a level of 520 volts which is a suitable breakdown level for sidac 26.

When the voltage on capacitor 24 reaches the sidac breakdown voltage, the sidac becomes conductive, rendering the SCR conductive and discharging capacitor 24 through winding portion 18, generating the high voltage in winding portion 19. The large magnitude capacitor 24 dumps considerable energy into the magnetic field of the reactor 14, e.g., 0.676 joules as compared with 0.0053 in a more conventional HPS starter, which excites the core of the reactor to a relatively high degree. The highly excited reactor with its corresponding collapsing magnetic field pushes the lamp into complete discharge and into a low impedance state so that the discharge can then be maintained by the normal AC source. The discharging capacitor 24 produces current flow which is in the same direction as the continued current flow produced by the collapsing field and is shoved through the lamp as the SCR 22 is turned off by the instantaneous back voltage bias placed on capacitor 24 by the same collapsing field energy.

In this controlled step-charging of the large energy storage capacitor 24, there is no need for a high wattage, low magnitude series-connected resistor which would produce high-wattage loss. Thus, the circuit is very efficient and does not generate heat.

A 10 ohm wire-wound resistor 37 can be connected in series with SCR 22 to cause the peak of the high voltage pulse to be lower and the base (width) of the pulse to be longer. This decreases the dielectric stress which allows use of lower cost magnetic components. This added resistance is so small that it does not cause measurable heating.

When the SCR becomes conductive, the high voltage generated across the ballast is also imposed on the RF choke as well as the lamp. The RF choke offers a very high impedance at the pulse frequency, thus assuring that the majority of the voltage appears across the lamp and protecting the components of circuit 40 from this high voltage. Capacitor 12 also serves as a high frequency bypass to cause the high voltage to appear across the lamps distributed capacitance system. If the lamp for some reason fails to reignite, the high voltage cycle described above repeats until the lamp starts. When the lamp reignites, the operating voltage of the lamp clamps the voltage across circuit 40 to approximately 110 volts, thereby automatically turning off the high voltage generating process during lamp operation.

Figure 2:
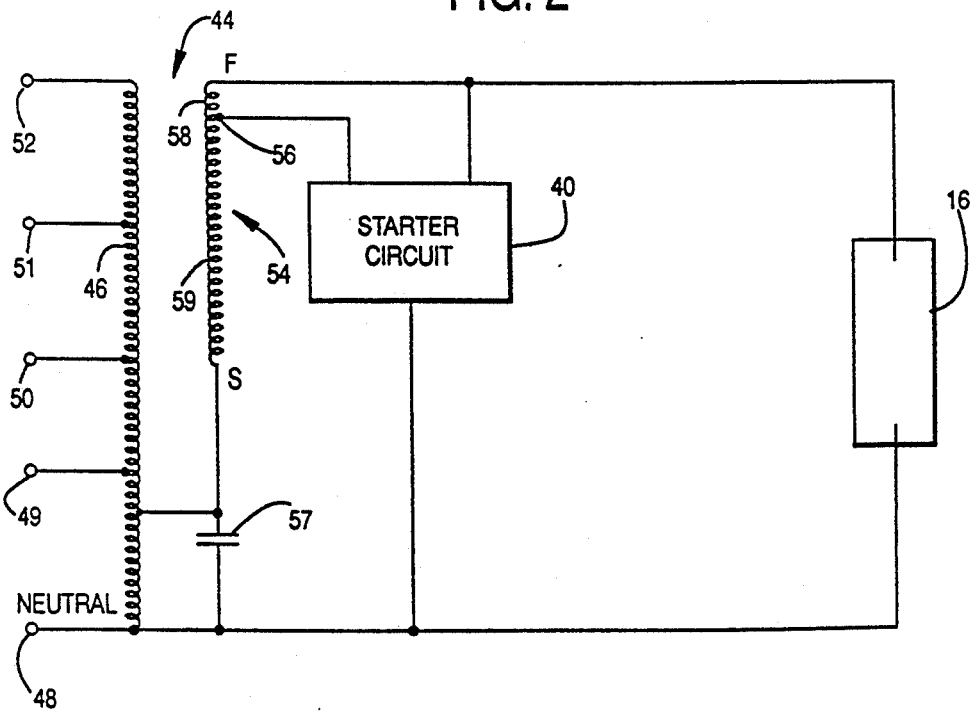
FIG. 2 is a schematic circuit diagram, partly in block form, of a starter circuit in accordance with FIG. 1 used with an auto-lag ballast.

FIG. 2 shows the use of circuit 40 with a different form of ballast, the FIG. 2 circuit having a tapped autolag ballast indicated generally at 44. Ballast 44 has a primary winding 46 with a neutral connection 48 and taps 49, 50, 51 and 52 which can be connected to various voltage sources such as, for example, 120 volts, 240 volts, 277 volts and 480 volts to taps 49 through 52, respectively. The ballast also includes a secondary winding 54 which has a tap 56 forming first and second winding portions 58 and 59 which function, in connection with the lamp and also in connection with starter circuit 40, as described with reference to winding portions 18 and 19. A bypass capacitor 57 can be connected between the secondary winding "start" end and ground to provide a low impedance path for the starting current. The circuit and its functions are thus essentially the same as described with reference to FIG. 1.

Figure 3:
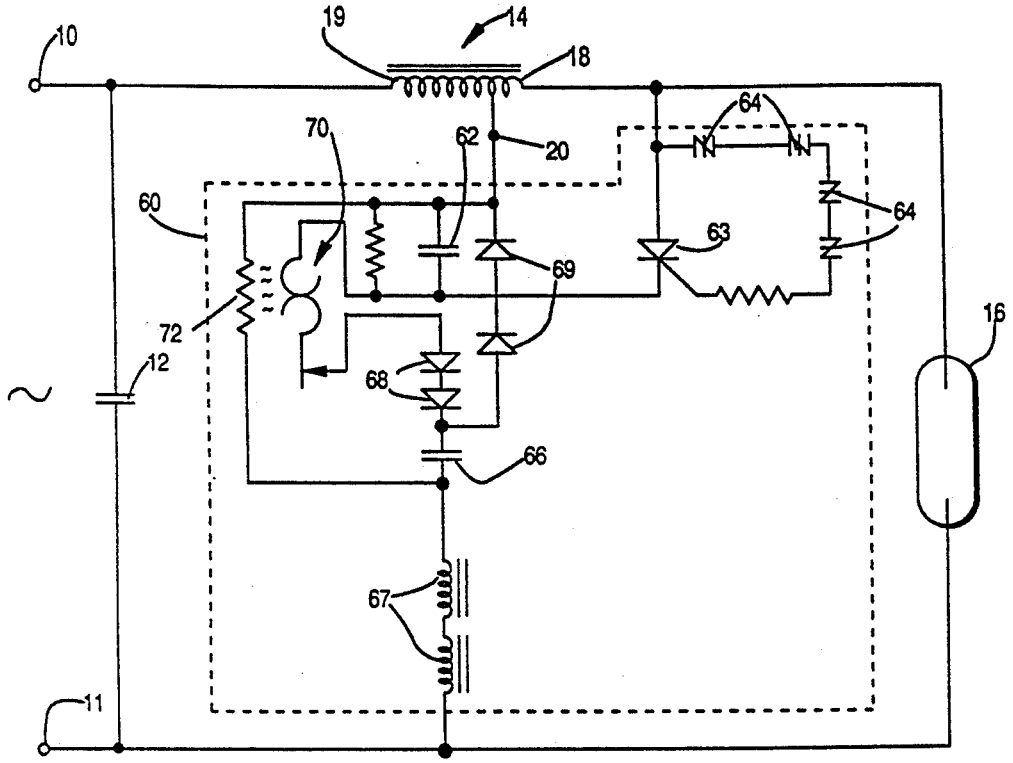
FIG. 3 is a further embodiment of a circuit in accordance with the present invention incorporating a thermal disabling device.

A further embodiment of a starter circuit is shown in FIG. 3, the starter circuit 60 shown therein being connected to the AC source, ballast and lamp as in FIG. 1. The circuit shown is particularly designed for use with a 600 watt high pressure sodium lamp 16.

The starting and hot restarting portions of circuit 60 are, in principal, the same as shown in FIG. 1 but are shown in FIG. 3 as having actual components therein. For example, storage capacitor 62 is a 5 microfarad, 400 volt DC capacitor which is connected to a 35 amp, 800 volt SCR 63. Four sidacs 64 are connected in series between the gate and anode of the SCR, each sidac having a breakdown voltage of 135 volts. The sidacs are connected in series with a 680 ohm resistor 65.

The pumping capacitor 66 is a 0.047 microfarad, 630 volt DC capacitor and the choke comprises two 50 mh chokes 67, connected in series. Diode 30 of FIG. 1 is replaced by two diodes 69, each of which is a 3 amp 600 volt rectifier. Two diodes 68, which are of the same type as diodes 69, are used to replace diode 36 of FIG. 1.

In addition to these component changes, the circuit of FIG. 3 is provided with a disabling circuit for the purpose of deactivating the starting circuit in the event that a lamp 16 is not capable of starting. The disabling circuit includes a thermostatic switch 70 connected in series with the charging circuit including pumping capacitor and diodes 68 which form the connection between the pumping capacitor and the storage capacitor. Switch 70 is a normally closed switch which opens at an elevated temperature of, for example, 110° C. A heating resistor 72 is connected in parallel with the portion of the charging circuit including the diodes and capacitors and in series with choke 67 so that current flows through heating resistor 72 whenever the circuit is energized. Resistor 72 and switch 70 can be placed in a controlled thermal relationship so that the heating of resistor 72 elevates the temperature of switch 70 in approximately three to five minutes, depending upon the ambient temperature in the fixture. When switch 70 opens, the step charging of the energy storage capacitor 62 is stopped. Switch 10 remains open because of the continuation of heating current flowing through resistor 72 until the primary power is turned off and then back on.

This automatic turn-off feature guarantees long product life and reliability because it limits the high voltage stressing of the dielectric components in the event of a failed lamp 16.

Figure 4:
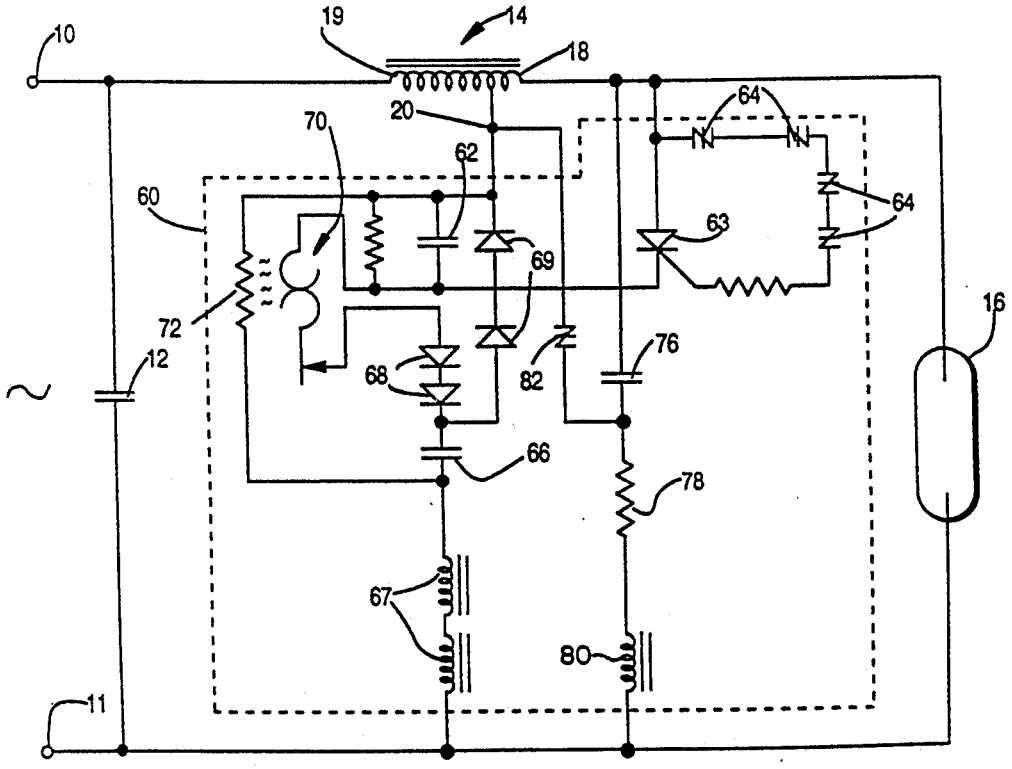
FIG. 4 is a schematic circuit diagram of a further embodiment of a starting and operating circuit in accordance with the present invention.

FIG. 4 illustrates the circuit of FIG. 3 with the addition of a more conventional HPS starting aid which includes a capacitor 76 connected in series circuit relationship with a resistor 78 and an RF choke 80, a sidac 82 or other similar breakdown device being connected between the resistor-capacitor junction and tap 20 of ballast 14. This circuit operates in a conventional fashion by building a charge on capacitor 76 through resistor 78 and choke 80 until the breakdown voltage of the sidac is reached, whereupon capacitor 76 discharges through first portion 18 of the ballast, producing a starting voltage pulse.

As will be recognized by those skilled in the art, the circuit including components 76, 78, 80 and 82 is well-known. This portion of the circuit can operate to start a lamp when it is cold, under normal starting conditions. Normally, a lamp can be started with high voltage, relatively low energy pulsing of the lamp to cause ignition and maintain an arc. However, such a circuit is not normally effective to restart a hot lamp. The control circuit 40 or 60 can thus be employed for hot restarting purposes with the more conventional starting circuit being effective to initiate operation of a cold lamp which does not have any other problems. It is important to note that the two circuits operate well in conjunction with each other and can be connected in the same starting arrangement without difficulty.

Figure 5:
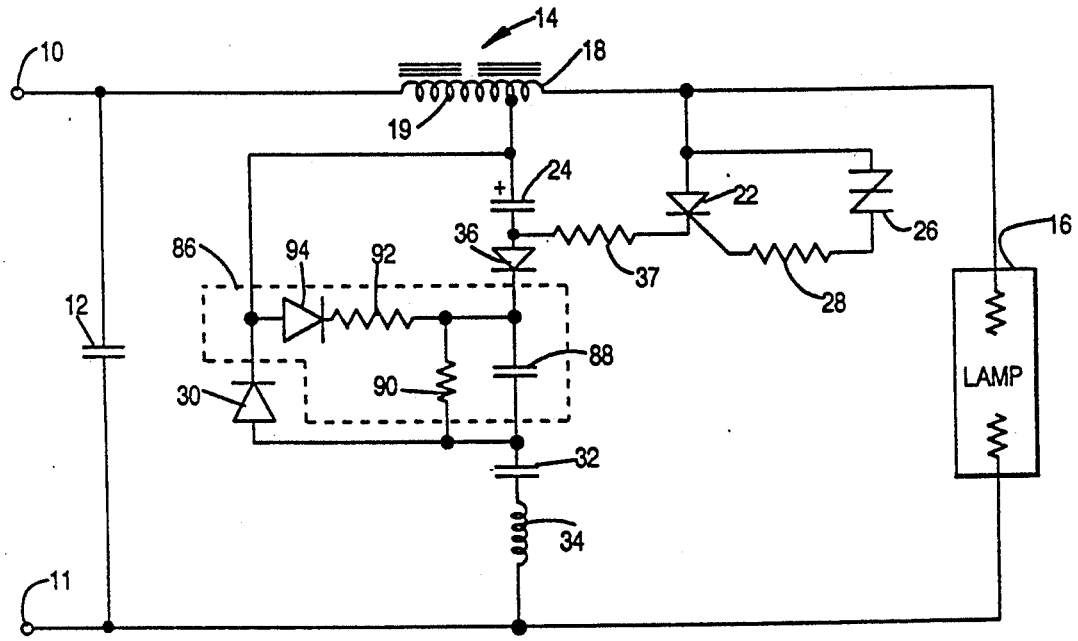
FIG. 5 is a further embodiment of a circuit in accordance with the present invention incorporating an electronic disabling device.

FIG. 5 shows a circuit which is basically like that of FIG. 1 but which includes a cutoff network 86 which is electronic in operation rather than thermal. Network 86 includes a capacitor 88 which has a value much larger than capacitor 24, in the order of 100 microfarads. A discharge resistor 90 having a value of about 100 kohms is connected in parallel with capacitor 88. A series charging circuit for capacitor 88 includes a resistor 92 and a diode 94, diode 94 being poled so that a charge is developed on capacitor 88 which is opposed to the charge developed on capacitor 24. Capacitor 88 is in the charge path for capacitor 24 but because it is much larger, the charge on capacitor 88 builds relatively slowly. The charge time of capacitor 88 is primarily determined by the value of the capacitor and of resistor 92 which can be on the order of 150 kohms.

When the circuit is energized the DC voltage across capacitor 88 rises slowly until it approaches the previously described voltage buildup across capacitor 24, opposing that voltage to such an extent that the voltage on capacitor 24 is inadequate to cause breakdown of sidacs 26. A good lamp generally starts on the first pulse. The use of a 0.22 mfd pumping capacitor 30 causes a pulse to be generated every 0.45 seconds. With the values given above for network 86, the pulses are terminated after four pulses and will be reinitiated only after the power has been removed and restored at which time the starting circuit will try again.

This cutoff network has the advantage over the thermal cutoff circuit that the former need not compensate for variations in ambient temperature in the lamp housing which can easily vary over the range of −30° C. to +90° C.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for starting and operating a high intensity discharge lamp comprising the combination of a pair of input terminals for supplying voltage to the apparatus;

a pair of output terminals for connection to a high intensity discharge lamp; means including a step-up transformer for coupling said input terminals to said output terminals; and a voltage multiplier circuit coupled to a primary winding of said transformer, said voltage multiplier circuit comprising means for blocking high-frequency current, a first capacitor and a first rectifier element connected in a first series circuit with said means for blocking high-frequency current to said primary winding, a second capacitor and a second rectifier element connected in a second series circuit with said means for blocking high-frequency current to said primary winding, a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting a discharge lamp connected to said output terminals; and circuit means for inhibiting the action of said second capacitor and starting of said lamp after a predetermined interval if said lamp has not ignited.

2. An apparatus according to claim 1 wherein said circuit means for inhibiting starting of said lamp comprises a third capacitor connected in a charging circuit for said second capacitor, and charging circuit means for charging said third capacitor, said charging circuit means including a diode poled to charge said third capacitor in a direction to oppose the charge developed on said second capacitor to thereby render said second capacitor ineffective to produce high voltage to be applied to said lamp, said third capacitor having a value larger than said second capacitor and a longer time constant such that said second capacitor discharges a predetermined plurality of times before the charge on said third capacitor is large enough to render said second capacitor ineffective.

3. An apparatus according to claim 2 and further including a 60 Hz voltage source connected to said input terminals.

4. An apparatus according to claim 1 and further including a 60 Hz voltage source connected to said input terminals.

5. An apparatus according to claim 4 wherein said step-up transformer comprises an autotransformer connected between a first one of said input terminals and one of said output terminals;

said first series circuit is connected between a tap on the winding of said transformer and a second one of said input terminals; and said second series circuit is connected between said tap and said second one of said input terminals.

6. An apparatus according to claim 5 wherein said first and second rectifier elements are oppositely polarized as viewed from a common terminal of said means for blocking high-frequency current.

7. An apparatus according to claim 6 wherein said means for blocking high-frequency current is a RF choke.

8. An apparatus for starting and operating a high intensity discharge lamp comprising the combination of a pair of input terminals for supplying voltage to the apparatus;

a pair of output terminals for connection to a high intensity discharge lamp;

means including a step-up transformer for coupling said input terminals to said output terminals, said transformer having a turns ratio of about 20:1; and a voltage multiplier circuit coupled to a primary winding of said transformer, said voltage multiplier circuit comprising means for blocking high-frequency current, a first capacitor and a first rectifier element connected in a first series circuit with said means for blocking high-frequency current to said primary winding, a second capacitor and a second rectifier element connected in a second series circuit with said means for blocking high-frequency current to said primary winding, a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting a discharge lamp connected to said output terminals.

9. An apparatus according to claim 8 wherein said step-up transformer comprises an autotransformer connected between a first one of said input terminals and one of said output terminals and having a tap point connected to said voltage multiplier circuit, said autotransformer having a winding with an inductance value sufficient to provide a current limiting ballast for a connected discharge lamp in the normal operation of said lamp.

10. An apparatus for starting and operating a high intensity discharge lamp comprising the combination of a pair of input terminals for supplying voltage to the apparatus;

a pair of output terminals for connection to a high intensity discharge lamp;

means including a step-up transformer for coupling said input terminals to said output terminals;

a voltage multiplier circuit coupled to a primary winding of said transformer, said voltage multiplier circuit comprising means for blocking high-frequency current, a first capacitor and a first rectifier element connected in a first series circuit with said means for blocking high-frequency current to said primary winding, a second capacitor and a second rectifier element connected in a second series circuit with said means for blocking high-frequency current to said primary winding, a voltage responsive switching device connected in a closed-loop series circuit with said second capacitor and said primary winding, whereby when said second capacitor is charged to the breakdown voltage of said switching device, said switching device becomes conductive to provide a discharge path for said second capacitor through said primary winding, thereby to induce in a secondary winding of said transformer a high voltage pulse for igniting a discharge lamp connected to said output terminals; and a normally closed, thermally actuated switch connected in series circuit relationship with said second diode, and a heating resistor coupled to said AC source, said heating resistor and said thermally actuated switch being mounted in good heat exchange relationship with each other so that current through said resistor elevates the temperature of said switch, said switch being selected to open after a predetermined interval of circuit operation to thereby deactivate said second capacitor if said lamp has not started during said interval.

11. An apparatus according to claim 10 wherein said second and first capacitors have capacitance values of $C_2$ and $C_1$, respectively, and wherein $C_2 >> C_1$.

* * * * *